10/8/85 OR 4,545,898

United States Patent [19]

Hellsten

[11] Patent Number: 4,545,898

[45] Date of Patent: Oct. 8, 1985

[54] PROCESS FOR FROTH FLOTATION

[75] Inventor: Karl M. E. Hellsten, Ödsmål, Sweden

[73] Assignee: Berol Kemi AB, Stenungsund, Sweden

[21] Appl. No.: 613,652

[22] Filed: May 23, 1984

[51] Int. Cl.[4] ..... B03D 1/14

[52] U.S. Cl. ..... 209/166; 209/167; 252/61

[58] Field of Search ..... 209/5, 166, 167; 252/61

[56] References Cited

U.S. PATENT DOCUMENTS

| | | | |
|---|---|---|---|
| 4,274,951 | 6/1981 | Goold | 209/167 |
| 4,324,653 | 4/1982 | Henchiri et al. | 209/167 |
| 4,358,368 | 11/1982 | Hellsten et al. | 209/167 |

FOREIGN PATENT DOCUMENTS

| | | | |
|---|---|---|---|
| 688233 | 9/1979 | U.S.S.R. | 209/167 |
| 858922 | 8/1981 | U.S.S.R. | 209/166 |
| 977042 | 11/1982 | U.S.S.R. | 209/166 |

*Primary Examiner*—Bernard Nozick

[57] ABSTRACT

A process for froth flotation of phosphate ore with a high content of carbonate, carried out in the presence of a hydrophilic polysaccharide and an amphoteric compound.

11 Claims, No Drawings

PROCESS FOR FROTH FLOTATION

Hydrocolloids of polysaccharides, such as starch, guar gum, gum arabic, and cellulose ethers, have since long been used in flotation processes as depressants for oxide minerals, such as calcite, dolomite, and hematite. Hereby a flotation concentrate with improved purity of the valuable mineral is obtained, while the amount of the valuable mineral recovered is not influenced or even reduced. The use of fatty acids such as oleic acid or linoleic acid as collectors in the flotation of phosphate containing minerals is also known. Other types of collectors used in the flotation of phosphate containing minerals are amphoteric compounds of the type disclosed in the U.S. Pat. No. 4,358,368 and the South African patent application No. 83/3093. It has, however, been found that certain types of phosphate compounds with a high weight ratio between the carbonate and phosphate mineral, i.e. higher than 1, are difficult to float with known phosphate collectors. At extremely high carbonate mineral contents, i.e. exceeding 50%, the flotation difficulties will be further accentuated, especially in the case the ore also contains noticeable amounts of iron containing minerals. Especially reagents of the amphoteric type have on this type of ore in certain cases been found to have very bad flotation properties.

By combining a known amphoteric collector and a known hydrophilic polysaccharide, it has now been found possible to float with high recoveries phosphate minerals from ores containing high amounts of carbonate minerals. This aim is achieved by the fact that the flotation is carried out in the presence of (a) an amphoteric collector reagent having the general formula $$R-(O)_n-(A)_p-CH_2-CH(OH)-CH_2-\underset{\underset{H}{|}}{\overset{\overset{R_1}{|}}{N^+}}-C_qH_{2q}Y^- \qquad \text{I}$$

where

R is a hydrocarbon or acyl group having from seven to twenty-four, preferably ten to eighteen carbon atoms;

each A is an oxyalkylene group having from two to four carbon atoms;

$R_1$ is an alkyl group having from one to four carbon atoms or hydrogen;

Y is the group COO or the group $SO_3$;

n is 0 or 1;

p is a number from 0 to 5; and q is 1 or 2;

and or salts thereof; and (b) a hydrophilic polysaccharide substituted with an anionic group such as sulphate, sulphite, or phosphate, or carboxylic acid or ester thereof and having a viscosity not exceeding 5000 mNs/m$^2$(cP), measured in a 1% water solution at 20° C. with a Brookfield Synchro-lectric Viscosimeter Model LTV, spindle No. 3 at 3 rpm. The reason why this combination of compounds gives high recoveries is not known, but a reasonable explanation is that the compounds (a) and (b) in question form a complex, which as a consequence of its polymeric nature will be more strongly adsorbed onto the phosphate mineral surfaces than the monomeric amphoteric collector reagent (a) alone.

This class of amphoteric collector reagents is known and disclosed in U.S. Pat. No. 4,358,368, the disclosure of which is incorporated by reference, and in South African patent application No. 83/3093. The acyl group for example may be heptanoyl, octanoyl, decanoyl, dodecanoyl, myristoyl, palmitoyl, stearoyl, oleoyl, linoleoyl, and linolinoyl.

Preferred amphoteric collector reagent to be used in the process according to present invention are those with the formula I, where n and q is 1, and $R_1$ is a methyl group, R is preferably a hydrocarbon group. Especially preferred are compounds, where Y is the group COO. The amphoteric compounds preferred can be produced in high yields by applying commercially easy available raw materials, and at the same time they have most satisfactory flotation properties when used in accordance with the invention. Methods for their production are described in the U.S. Pat. No. 4,358,368.

The polysaccharides applied in the flotation process according to the invention must be hydrophilic. By this is understood that they must be water soluble to such an extent that they can form 1% molecular dispersions or colloidal solutions with water at 20° C. The polysaccharides having a relatively low viscosity in a 1% water solution exhibit the best results. A suitable viscosity is below 4000, preferably below 1000 mNs/m$^2$. The substitution degree of the polysaccharides can be varied within wide limits, but usually it is within the range of from one anionic substituent per polysaccharide molecule to one anionic substituent per anhydroglucose unit. Examples of anionic substituents are carboxymethyl groups, carboxylic groups, sulphate groups, sulphonate groups, and phosphate groups. Examples of carboxylic acid ester substituents are methyl and ethyl acetic and propionic acid esters. Suitable hydrophilic polysaccharides are carboxymethylcellulose (CMC), sulphomethylcellulose, gum arabic, karaya gum, tragacanth gum, gum ghatti, alginate, and starch such as corn starch, and anionic starch derivatives such as carboxymethyl starch and starch phosphate.

The flotation properties can further be improved by the addition of a hydrophobic secondary collector, preferably in the form of a polar, water-insoluble, hydrophobic compound having an affinity for the mineral particles, on which the amphoteric compound will be adsorbed. The amphoteric compound and the polysaccharide are usually both added in an amount within the range from about 10 to about 1000, preferably from 20 to 750, g per ton of ore, and the polar, water-insoluble, hydrophobic compound in an amount within the range from 0 to about 1000, preferably from 5 to 750, g per ton of ore. In the case that the amphoteric compound is used together with the hydrophobic compound, the ratio between them may be varied within wide limits, but normally it is within the range from about 1:20 to about 20:1, preferably from 1:5 to 5:1. The water-insoluble hydrophobic compound, which according to the invention can be regarded as a secondary collector, preferably is a polar compound if desired dissolved in a hydrocarbon solvent.

In order to obtain a stable emulsion in water and a good distribution, a conventional emulsifier can be added, e.g. a nonionic surface active compound, which if it is water-insoluble shall be included with the polar compound. Suitable polar compounds are water-insoluble soaps, such as calcium soaps; water-insoluble surface-active alkylene oxide adducts; organic phosphate compounds, such as tributyl phosphate and tri(2-ethyl hexyl)phosphate; and esters of carboxylic acids, such as tributyl ester and tri(2-ethyl hexyl)ester of NTA, and dioctylphthalate.

When applying the process according to the invention pH-regulating substances as well as frothers, depressants, and activators can be added in known manner. In most flotation processes the pH value is of importance in obtaining a good separation. The flotation process according to the invention is also dependent on the pH value, and this makes it possible to optimize the separation of different minerals by selection of a suitable pH value.

Thus, the character of the amphoteric surface active compound varies considerably with the pH value. At a pH value below 6 it is mainly cationic, while it is chiefly anionic at a pH value above 10, and zwitterionic at a pH value between 6 and 10. In the separation of ore containing apatite and gangue minerals such as silicate and/or calcite, a good selective enrichment is obtained if the flotation is carried out at pH values within the range from about 7 to about 12. General rules are impossible to give, as each ore finally has to be treated in accordance with its own chemical and physical composition.

The process according to the invention is further illustrated by the following Examples.

EXAMPLES 1 TO 7

1000 g of an ore sample containing, calculated by weight, 8% apatite, 70% carbonate minerals as calcite and dolomite, 14% silicates, 5% iron containing minerals, and 3% other minerals, was ground in a laboratory mill to such a particle size that 80 percent by weight passed through a sieve with the mesh size of 200 μm. Then water and NaOH were added in order to obtain a slurry containing 33 percent by weight of solids, and having a pH value of 11. The pulp obtained was conditioned for 5 minutes together with 0.25 g of one of the following hydrophilic polysaccharides:

| Example | Polysaccharide | Viscosity (mNs/m²) |
|---|---|---|
| 1 | Gum arabic | 200 |
| 2 | Karaya gum | 2280 |
| 3 | gum ghatti | 200 (not completely soluble) |
| 4 | Tragacanth gum | 640 |
| 5 | Sodium alginate | 200 |
| 6 | Carboxymethylcellulose (MS = 0.55) | 200 |
| 7 | Corn starch, prehydrolyzed | 200 |
| Control | No polysaccharide (but with amphoteric compound) | — |

After conditioning an addition was made to all samples of 0.25 g of an aqueous additive containing 25 percent by weight of the amphoteric compound (a):

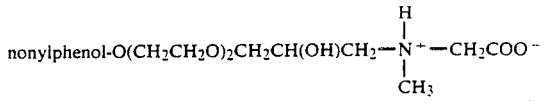

and 35 percent by weight of a water-insoluble, but water-dispersible ethylene oxide adduct as a hydrophobic secondary collector. After further conditioning for 5 minutes at a pH value of 11 the slurry was subjected to rougher flotation followed by 3 cleaning steps. The following results were obtained.

TABLE I

| | Rougher Flotation $P_2O_5$ | | Concentrate | | | | | |
|---|---|---|---|---|---|---|---|---|
| | | | Cleaner 1 $P_2O_5$ | | Cleaner 2 $P_2O_5$ | | Cleaner 3 $P_2O_5$ | |
| Example | Content % | Recovery % | Content % | Recovery % | Content % | Recovery % | Content % | Recovery % |
| Control | 7.7 | 17.1 | 12.0 | 15.8 | Not Run | | Not Run | |
| 1 | 18.9 | 80.7 | 24.5 | 80.0 | 28.4 | 79.5 | 34.3 | 77.6 |
| 2 | 20.2 | 54.8 | 36.1 | 53.2 | 39.5 | 50.2 | 40.5 | 43.2 |
| 3 | 13.9 | 85.6 | 20.0 | 83.8 | 26.4 | 81.4 | 33.9 | 75.7 |
| 4 | 15.5 | 72.7 | 25.2 | 69.9 | 34.5 | 64.9 | 39.8 | 45.6 |
| 5 | 10.1 | 63.5 | 15.7 | 61.1 | 24.7 | 55.5 | 36.7 | 30.2 |
| 6 | 12.7 | 82.3 | 17.7 | 80.3 | 27.3 | 74.1 | 36.8 | 45.1 |
| 7 | 16.6 | 59.7 | 28.1 | 53.2 | 37.7 | 38.1 | — | — |

From the results it is evident that the method according to the invention is superior to the control. The control results were so bad, the test was discontinued after the first cleaning step.

Having regard to the foregoing disclosure the following is claimed and the inventive and patentable embodiments thereof:

1. Process for froth flotation of phosphate ore, comprising carrying out the flotation in the presence of (a) an amphoteric collector reagent having the general formula:

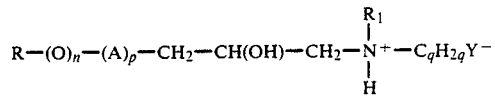

I where

R is a hydrocarbon or acyl having from about seven to about twenty-four carbon atoms;

each A is oxyalkylene having from two to four carbon atoms;

$R_1$ is alkyl having from one to four carbon atoms or hydrogen;

Y is the $COO^-$ or the group $SO_3^-$;

n is 0 or 1;

p is a number from 0 to 5; and q is 1 or 2 and salts thereof and (b) a hydrophilic polysaccharide substituted with an anionic group or an ester thereof and having a viscosity not exceeding 5000 mNs/m² (cP) measured in a 1% water solution at 20° C. with a Brookfield Synchrolectric Viscosimeter Model LTV, spindle No. 3 at 3 rpm and recovering phosphate in the froth.

2. Process according to claim 1, in which the hydrophilic polysaccharide has a viscosity below 1000 mNs/m².

3. Process according to claim 1, in which the hydrophilic polysaccharide is selected from the group consisting of carboxymethylcellulose, sulphomethylcellulose, gum arabic, karaya gum, tragacanth gum, gum ghatti, alginate, starch, and anionic starch derivatives.

4. Process according to claim 1, in which the amphoteric compound and the hydrophilic polysaccharide are both added in an amount of from about 10 to about 1000 g per ton of ore, and that the hydrophobic secondary collector is added in an amount of from 0 up to about 1000 g per ton of ore.

5. Process according to claim 1, in which the R hydrocarbon or acyl has from ten to eighteen carbon atoms.

6. Process according to claim 1, in which R is hydrocarbon.

7. Process according to claim 1, in which R is acyl.

8. Process according to claim 1, in which n and q is 1, and $R_1$ is a methyl group.

9. Process according to claim 8, in which Y is $COO^-$.

10. Process according to claim 1, in which in addition to the amphoteric compound and the hydrophilic polysaccharide, the flotation is carried out in the presence of a hydrophobic secondary collector.

11. Process according to claim 10, in which the secondary collector is a polar, water-insoluble compound.

* * * * *